US011333001B2

(12) United States Patent
Sewell et al.

(10) Patent No.: US 11,333,001 B2
(45) Date of Patent: May 17, 2022

(54) PULSING FRACING APPARATUS AND METHODOLOGY

(71) Applicants: Frederic D. Sewell, Dallas, TX (US); Dennis Gleason, Dallas, TX (US)

(72) Inventors: Frederic D. Sewell, Dallas, TX (US); Dennis Gleason, Dallas, TX (US)

( * ) Notice: Subject to any disclaimer, the term of this patent is extended or adjusted under 35 U.S.C. 154(b) by 0 days.

(21) Appl. No.: 16/885,125

(22) Filed: May 27, 2020

(65) Prior Publication Data

US 2021/0087903 A1 Mar. 25, 2021

Related U.S. Application Data

(62) Division of application No. 16/576,745, filed on Sep. 19, 2019, now Pat. No. 10,822,914.

(51) Int. Cl.

| | |
|---|---|
| ***E21B 47/06*** | (2012.01) |
| ***E21B 33/13*** | (2006.01) |
| ***E21B 43/267*** | (2006.01) |

(52) U.S. Cl.

CPC ..... *E21B 33/13* (2013.01); *E21B 43/267* (2013.01); *E21B 47/06* (2013.01)

(58) Field of Classification Search

CPC ..... E21B 33/13; E21B 43/267; E21B 47/06

See application file for complete search history.

(56) References Cited

U.S. PATENT DOCUMENTS

| | | | | |
|---|---|---|---|---|
| 5,351,754 | A | 10/1994 | Hardin et al. | |
| 9,212,543 | B2 * | 12/2015 | Stormoen | E21B 43/26 |
| 9,222,346 | B1 | 12/2015 | Walls | |
| 9,222,347 | B1 | 12/2015 | Walls | |
| 10,745,991 | B2 * | 8/2020 | Kajaria | F16K 3/02 |
| 2014/0151065 | A1 * | 6/2014 | Stephenson | E21B 21/106 166/374 |
| 2016/0123127 | A1 * | 5/2016 | Walls | E21B 33/068 166/244.1 |
| 2019/0153799 | A1 * | 5/2019 | Hardesty | E21B 33/12 |

OTHER PUBLICATIONS

Stephen Rassenfoss, Real Fractured Rock is So Complex It's Time for New Fracturing Models, Journal of Petroleum Technology, Sep. 19, 2018, https://jpt.spe.org/real-fractured-rock-so-complex-its-time-new-fracturing-models , US.

* cited by examiner

*Primary Examiner* — Silvana C Runyan
(74) *Attorney, Agent, or Firm* — Carrington, Coleman, Sloman & Blumenthal, L.L.P.

(57) ABSTRACT

A diverter for obstructing and temporarily sealing a perforation in a well casing in a subterranean formation during hydraulic fracturing. The diverter comprises an outer surface and circuitry within the outer surface for determining a pressure proximate the diverter.

10 Claims, 12 Drawing Sheets

1000

PULSING FRACING APPARATUS AND METHODOLOGY

RELATED APPLICATIONS AND CROSS-REFERENCE TO RELATED APPLICATION

This application relates to U.S. Pat. No. 9,903,178, issued Feb. 27, 2018, entitled "HYDRAULIC FRACTURING WITH STRONG, LIGHTWEIGHT, LOW PROFILE DIVERTERS," which is hereby incorporated fully herein. This application also is a divisional of, and claims the benefit of and priority to, U.S. application Ser. No. 16/576,745, filed Sep. 19, 2019, which is hereby fully incorporated herein by reference.

BACKGROUND

The preferred embodiments relate to oil and gas fracing and production.

Oil and gas production has used a process called hydraulic fracturing ("fracing") since the late 1940s, where the fracing process is used to further fracture deep underground rock formations so as to enhance the release of oil and/or gas. In further detail, fracing is preceded by first drilling a vertical well to a depth that can be one to two miles or more, and once the vertical well reaches a certain depth, then extending the well horizontally, which extension can be an additional mile or more. The well is then encased with steel pipe cemented in the hole. Thereafter, and typically in repeated stages, corresponding to respective segments of length along the well, a number of perforations are formed along a segment of the steel pipe. Next, a high pressure, high flow rate fluid is introduced into the well, the fluid comprising overwhelmingly water, and also may include proppant (normally sand and/or ceramic) particles and a relatively small amount (e.g., less than two percent) of one or more additives/chemicals. The high pressure frac fluid passes through the already-formed perforations in a particular well segment and into the rock formation adjacent and proximate the perforations. Once a stage is fraced, it is isolated typically by a drillable plug, and then the process repeats for a next stage, until multiple (or all) stages likewise have been fraced.

In more detail, once the fracing mixture exits the well casing and enters the adjacent formation, its pressure will further fracturing the natural fractures of the rock formations it reaches. Thus, the fracing materials and process thereby stimulate or improve production, for example from low permeability rock formations containing oil or gas, by creating or enlarging fractures within the formations. Moreover, in instances when the frac fluid includes sand or other particles, those particles will not only assist in applying pressure to and expanding the rock fractures, but once the fluid pressure is reduced or eliminated, those materials may remain in place, thereby maintaining or "propping" those expanded structures in place; accordingly, such materials are sometimes referred to as proppants. Thus, fracing extends fractures already present in the formation, and causes new fractures, resulting in a network of fractures that substantially increases the permeability of the formation near the wellbore, and proppants can maintain the network of fractures for a period of time to enhance subsequent oil/gas production, once the fracing process is completed. Also of note, as an alternative to proppants, the frac fluid may include acid, in which case the acid creates the fractures in the formation and etches or dissolves the fracture faces unevenly, thereby forming dissimilar fracture faces that can only partially close leaving fractures through which oil or gas can flow more freely.

Common examples of proppants include silica sand, resin-coated sand, and ceramic beads (and possibly mixtures of them). Because silica sand is the predominant proppant used for fracing, "sand" has become petroleum industry jargon for any type of proppant or combination of proppants used in fracing. Therefore, the term "sand" in this document refers to any type of propping agent, or combinations of them, suitable for holding open fractures formed within a formation by a fracing operation unless otherwise plainly stated. The term "frac fluid" will be used to refer to any type of hydraulic fluid used for fracing that may be used to form fractures and/or enlarge natural fractures in the formation. Frac fluids may be water-based, oil-based, acid or acid-based, and or foam fluids. Additives also can be used to control desired characteristics, such as viscosity. Further, references to "frac fluid and sand" in the context of fracing are intended to also include frac fluid and acid unless the context states or plainly indicates otherwise.

Because of differences in permeability of the rock at each of the perforations due to different porosities or existing fractures (both naturally occurring and caused by perforating the casing), the rate at which frac fluid flows through perforations distributed along a wellbore may, and almost always does, vary along the length of the wellbore. When stimulating vertical wellbores over 60 years ago the petroleum industry frequently used a high number of perforations (up to 4 perforations per foot of casing) throughout most of the oil and gas pay zones of a wellbore. Such a large number of perforations resulted in the frac fluid and sand flowing first into more permeable rock. This resulted in fractures in the more permeable rock formations being packed with too much of the sand (or acid), which was intended to be distributed approximately equally through the perforations and into adjacent formations. The less permeable formations were, consequently, not being sufficiently fractured. As a result of this variance, a prior art approach was to introduce so-called diverters into the wellbore at certain points during the fracturing process, where the diverters would tend to seal the paths of least resistance, thereby diverting the frac fluid to other perforations and, hence, causing frac in rock formation areas of higher resistance. Historically, such diverters were solid, hard rubber balls, sometimes referred to as "ball sealers." More particularly, after pumping a portion of the frac fluid with sand or acid, multiple ball sealers were pumped into the well and carried by the frac fluid to the perforation being stimulated. The balls temporarily sealed some of the perforations—those adjacent to fractures formed in the more permeable rock—and diverted the frac fluid, with the sand or acid, away from the stimulated perforations to other perforations in the next most permeable zone of rock that had not yet been stimulated. After pumping of frac fluid ceases, the ball sealers, no longer being held against the perforations by the differential pressure between the frac fluid within the wellbore and the formation, fall off of the perforations to allow hydrocarbons from the fractured formation to flow into the well. However, the need for the relatively large and heavy ball sealers in vertical wellbores was minimized when industry began to selectively perforate only the better permeable zones (commonly referred to as "limited entry").

For horizontal or highly deviated directional oil and gas wells, the conventional petroleum industry practice today is to frac lateral wellbores in stages. Typically a large number of stages are employed to frac a lateral wellbore extending 4,000 to 7,500 feet or more, where the number can be in the hundreds. Each frac stage may have 4 to 8 clusters of perforations, with each cluster typically having 6 perforations. The purpose of frac in multiple stages is to distribute a generally equal amount of frac fluid and sand to all perforations in a manner that achieves optimal stimulation of each perforation along the entire length of the lateral portion of the wellbore, thereby creating extensive cracking/fracturing of the rock formation surrounding the casing along its entire length. Each frac stage is isolated from the other stages and perforated and fraced separately. The petroleum industry experience of fracing a huge number of horizontal wells drilled to date appears to indicate that a large number of stages are required to ensure that a reasonably equal and sufficient volume of frac fluid and sand are pumped into each perforation. In the past few years, developments in hydraulic fracture technology indicate that superior stimulation results are achieved by using larger volumes of frac fluid and sand (15 million gallons and 15 million pounds of sand and more) pumped at extremely high rates (80 to 100 barrels per minute) and pressures (8,000-9,000 psi and more). The velocity of the frac fluid through the wellbore may reach or exceed 90 feet per second. Therefore, the industry continues to use the high-cost, multiple fracing stages in an effort to distribute generally equal amounts of frac fluid and sand to all perforations in the lateral casing.

The commercial value of drilling horizontal wells with longer laterals and multiple stages fraced with larger volumes of frac fluid and sand pumped at high velocity and pressure has been established by achieving robust wells that have higher oil and gas producing rates and estimated ultimate recoveries of oil and gas. Effective frac stimulation of most or perhaps all of the perforations in a horizontal casing creates an extensive fracture system that opens and connects more reservoir rock to the wellbore. However, such frac jobs with a large number of stages are time consuming and expensive due to the repetitive plug, perforate, and frac operation required to isolate and frac each individual stage. Completion costs typically represent about one-half of the total drilling and completion costs of a horizontal well. Although it is tempting to reduce costs by reducing the number of frac stages and increasing the number of perforations to be stimulated per stage, fewer stages with more perforations per stage risks partial or unequal stimulation of the perforations within the stages. Wells with ineffective stimulation have lower initial production rates and lower ultimate recovery of oil and gas.

SUMMARY

In one preferred embodiment, there is a diverter for obstructing and temporarily sealing a perforation in a well casing in a subterranean formation during hydraulic fracturing. The diverter comprises an outer surface and circuitry within the outer surface for determining a pressure proximate the diverter.

Other aspects are described and claimed.

DETAILED DESCRIPTION OF EXEMPLARY EMBODIMENTS

Figure 1:
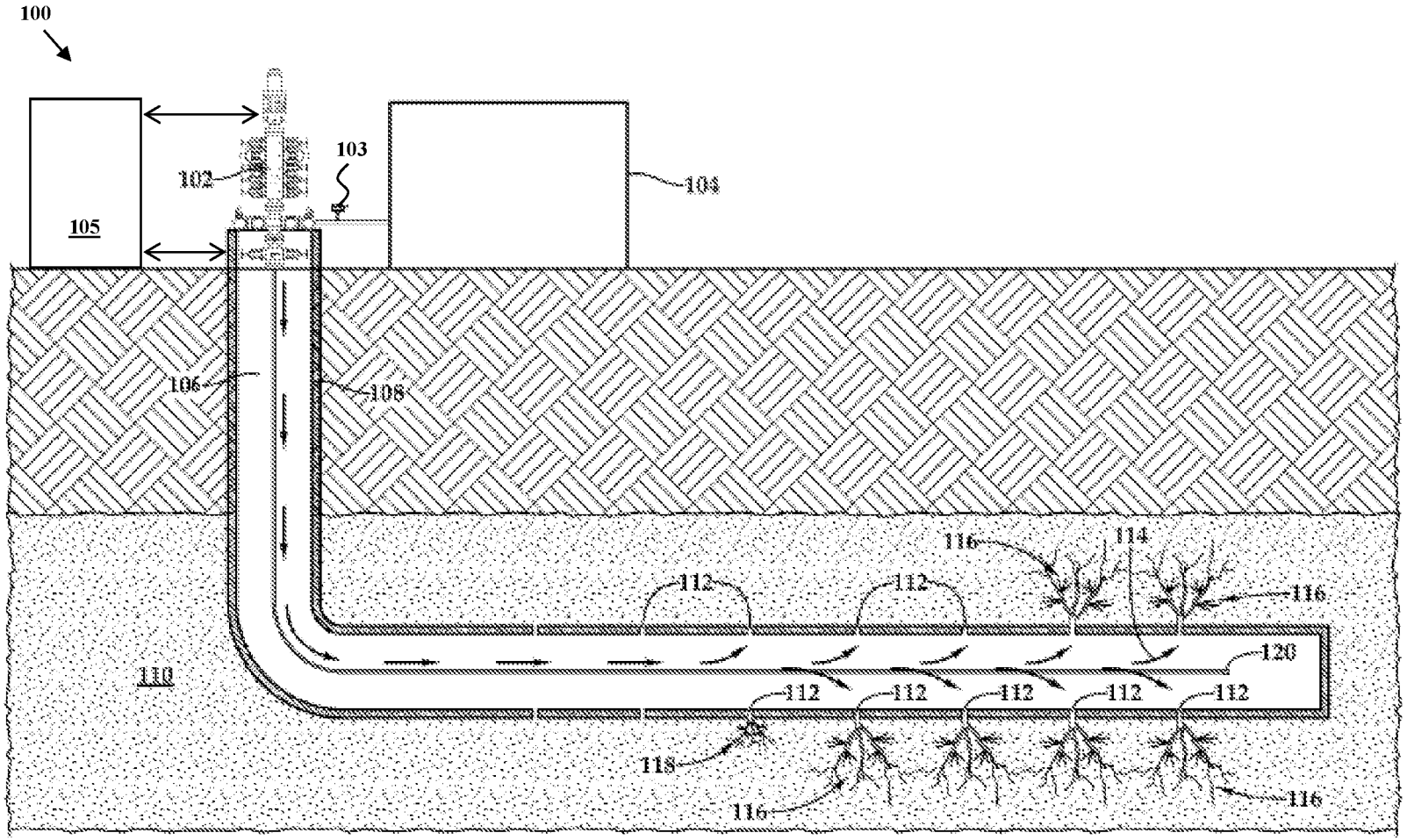
FIG. 1 is a simplified, schematic illustration of a well site with a wellbore within a formation undergoing hydraulic fracturing.

The following description, in conjunction with the appended drawings describe one or more representative examples of embodiments in which the invention claimed below may be put into practice. Unless otherwise indicated, they are intended to be non-limiting examples for illustrating the principles and concepts of subject matter that is claimed. Like numbers refer to like elements in the drawings and the description.

FIG. 1 is a schematic illustration of a representative example of a wellbore undergoing fracing. It is not to scale. In this implementation the well site 100 has a well head 102 disposed at a top of a wellbore 106. The well head 102 includes one or more couplings (e.g., via a manifold or the like) to a source of frac fluid 104. The source 104 may be comprised of one or more tanks, reservoirs, or other storage structures for fluid and sand or acid. The well head 102 may include, or have coupled with it, various equipment 105 to include sensors, including or separately a surface pressure sensor 103, and with various computational and/or transceiver functions as detailed later in connection with evaluating pressure in, and associated with, the wellbore 106. Equipment 105 also may communicate with the well head or other associated apparatus in connection with providing control relating to the flow from the source 104 and, as detailed later the introduction of diverters into the wellbore 106. Further, the surface pressure sensor 103 may be arranged to measure fluid pressure at the well head 102. Frac fluid stored in the source 104 may be mixed with a sand (or other particles, such as ceramic) or acid. Alternatively, sand or acid is introduced to the fluid at or upstream of the well head 102. In some implementations, for example when the target subterranean formation is a carbonate formation, the frac fluid may contain acid, in which case proppants may be unnecessary as the acid eats away the formation so that it cannot close. The well head 102 controls the injection of frac fluid into the wellbore 106. The wellbore 106 may be horizontal, deviated, or vertical. In the example of FIG. 1, the wellbore 106 extends horizontally into a target subterranean formation 110. The wellbore 106 is cased using a steel pipe 108 that is cemented in place. However, in some applications, the casing may not be cemented. Also, a casing liner may be used for the lateral section of the wellbore.

Perforations 112 are formed through the well casing 108 to expose the surrounding subterranean formation 110 to the interior of wellbore 106, thereby allowing pressurized frac fluid with sand or acid to be injected through the perforations into the subterranean formation. The well casing 108 may be perforated using any known method that produces perforations of a relatively consistent and predictable size. For example, perforations 112 may be formed by lowering shaped blasting charges into the well to a known depth, thereby creating clusters of perforations at desired points along the wellbore 106. In a typical application, perforations will, for example, be 0.4 to 0.5 inches in diameter, but in other applications they may have smaller or larger diameters.

During fracing operations, frac fluid will be pumped through the well head 102 and into the wellbore 106. The fluid will flow toward the perforations 112, as indicated by flow lines 114, and then out of the perforations 112 and into formation 110 to create new or enlarged fractures 116 within the formation. In this demonstrative, schematic illustration of FIG. 1, fractures 116 of the formation is indicated next to only some of the perforations, but not all. The fractures in this example are occurring in a portion or area of the formation into which more frac fluid is flowing due to, for example, higher permeability than the formation adjacent to the remaining perforations, which are indicated in the figure as having no new or enlarged fracturing, though in practice, new fractures or enlargement of existing fractures may in fact be taking place to a smaller degree.

In some implementations, a downhole pressure sensor (or pressure sensor array, or plural sensors) 120 may be placed lowered into the horizontal portion of wellbore 106 near the perforations 112 to measure the pressure of the frac fluid close to perforations 112. Indeed, as detailed below, in certain preferred embodiments, pressure sensing is achieved downhole by associating pressure sensing apparatus with selected diverters.

Although, in this example, the wellbore 106 is not divided into multiple frac stages, the wellbore 106 within the formation to be fraced can be divided into frac stages, with each stage separately isolated and fraced. The diverters and fracing method described below can be used with multiple stage fracing. However, the diverters allow for a reduction in the number of stages that is otherwise required to achieve similar results. They also can be used to frac without stages the entire wellbore within the zones of the formation expected to produce oil or gas.

Figures 2A, 2B, 2C, 2D, 2E, 2F:
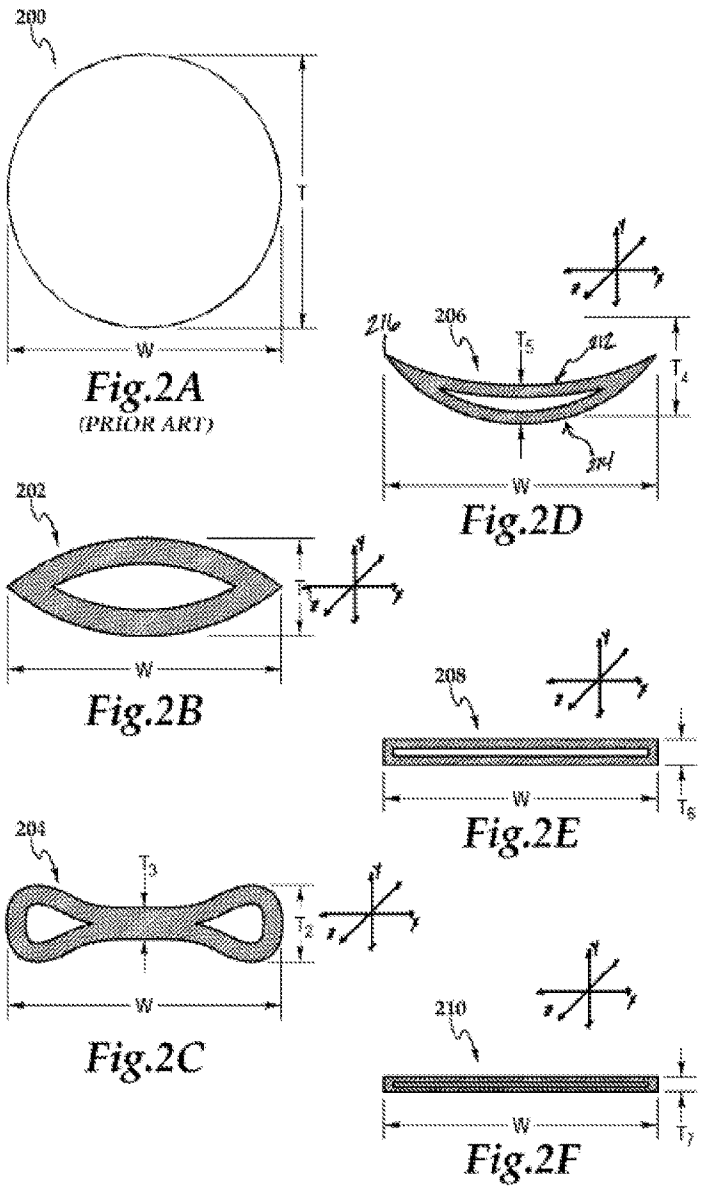
Fig.2A (PRIOR ART)
FIG. 2A is representation of a prior art ball sealer.
FIG. 2B is a representation of a first embodiment of a low profile diverter in cross-section.
FIG. 2C is a representation of a second embodiment of a low profile diverter in cross-section.
FIG. 2D is a representation of a third embodiment of a low profile diverter in cross-section.
FIG. 2E is a representation of a fourth embodiment of a low profile diverter in cross-section.
FIG. 2F is a representation of a fifth embodiment of a low profile diverter in cross-section.
Figure 3:
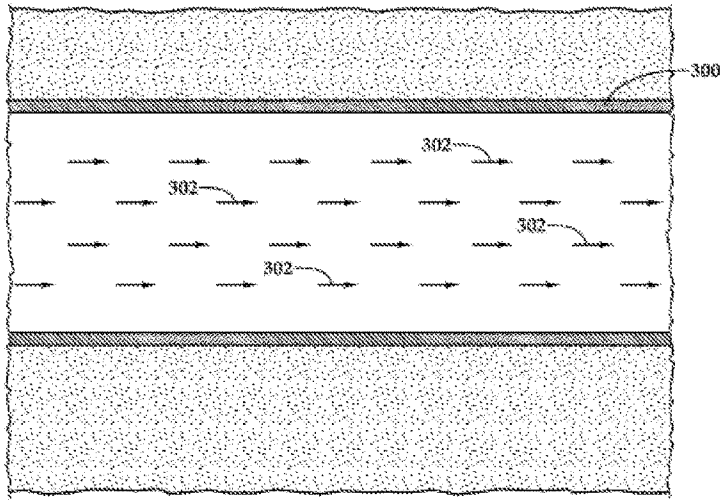
FIG. 3 represents a short section of a representative non-perforated cased horizontal wellbore upstream of the perforated representative wellbore shown in FIG. 4.

FIG. 2A illustrates, for purposes of comparison, a conventional, solid ball sealer 200 of the type found in the prior art. It has uniform diameter. Its width "W" is equal to its height "T," which is equal to its diameter. The diverters 202, 204, 206, 208 and 210 of FIGS. 2B-2F illustrate different cross-sectional shapes of a new type of diverter that is relatively thin and lightweight (as compared to ball sealers), strong, and has a lower profile as compared to the prior art spherical diverter. The low profile diverters are sized to extend over and temporarily seal stimulated perforations, thereby diverting the flow of the frac fluids and proppants to non-stimulated perforations. Each such low profile diverter has, in a preferred embodiment, an impermeable body with dimensions measured along each of two axes (the x and z axes in the coordinate frame illustrated in the figures), large enough to cover and temporarily seal a perforation in a well casing of a size that is typically made or that might be made for the particular application. In these examples each has the same width W, which is the diameter of ball sealer 200 (FIG. 2A). But, unlike a ball sealer, each has a dimension along an axis orthogonal to the other two axes (the y-axis) that is a substantially smaller than dimensions of the diverter along the first two axes, resulting in a relatively thin cross-section (or profile) that reduces drag caused by fluid flowing past the diverter while it seals a perforation. Due to the reduced drag, such a diverter is more capable of seating onto perforations and sealing them off without being unseated by continued fluid flow over or past the diverters. The shape of the outer circumference of diverters in a plan view, which would be along the y-axis, or the cross-sectional shape of the diverters when sectioned normal to the y-axis, is circular in the examples given. However, other shapes could be used as long as the shortest dimension of the diverter in the x and z dimensions is large enough to cover and temporarily seal the expected perforations. Non-limiting examples of such shapes are oval, squarer, and polygonal shapes. Other shapes are possible.

When introduced into a flow of frac fluid into a wellbore during fracing, each diverter 202 to 210 is intended to temporarily seal one perforation after it has been stimulated with frac fluid and sand or acid. Also in this regard, in some preferred embodiments, note that the shape, configurations, and outer perimeters shown in FIGS. 2B through 2F may be temporarily augmented with an external and dissolvable material to approach an initial spherical outside shape, so that the temporary spherical outer shape confirms to the same apparatus used in the prior art for loading spherical diverters into the wellbore 106. Thus, the temporary outer spherical shape operates compatibly with a spherical loading/unloading diverter launching device (not shown), so that diverters can be loaded into the diverter launching device and launched into the wellbore 106 having the spherical external shape, and thereafter the outer dissolvable material dissolves as the diverter travels with the frac fluid in and through the wellbore 106, whereby the dissolvable material is thusly removed from the exterior shape/configuration of the diverter, returning its shape as depicted in one of FIGS. 2B through 2F.

Further with respect to the shapes in FIGS. 2B through 2F, the specific cross-sectional areas for these diverters will vary based on different design and manufacturing considerations, the illustrated cross-sections of diverters 202 to 210 have much lower cross-sectional areas—preferably, 75 to 95 percent less—than the ball sealer 200 (or a comparable ball sealer capable of sealing similarly sized perforations). They are, therefore, subject to substantially less drag force exerted by fast moving frac fluid than a traditional ball sealer. This large reduction in drag force allows the diverters to seat on and form a temporary seal of the stimulated perforations more easily and reliably. The relatively small cross-sectional area of such diverters thus minimizes the risk that the high velocity frac fluid flowing through the perforated liner could cause (1) failure of some diverters to seat on and seal stimulated perforations, or (2) diverters to be unseated from the stimulated perforations before completion of the frac job. The temporary seal is broken, and the diverters unseat, when the frac fluid pressure drops and the pressure differential across the diverter drops to the point that there is insufficient pressure to hold them against the perforations, thus allowing hydrocarbons to flow into the well from the formation.

Turning now to the specific examples of low profile diverters shown in FIGS. 2B-2F, the diverters are positioned to show their minimum cross-sectional width W along the x axis of the coordinate frame adjacent to each of the figures. As previously mentioned, each is shown with the same width as ball sealer 200 for purposes of comparison. Diverter 202 of FIG. 2B is shaped generally as a discus having an overall or greatest thickness T (measured along the y axis). The greatest thickness of the diverter 202 is in the center, and the thickness tapers towards side edges of the diverter. In comparison to the ball sealer 200, the discus shaped diverter 202 has the same minimum width W, but a considerably smaller thickness $T_1$. The cross-sectional area of diverter 202 is much less than the cross-sectional area of the ball sealer 200, and has a resistance to the flow of frac fluid estimated to be 25% of the resistance of the ball sealer 200. Accordingly, the discus shaped diverter 202 is capable of sealing a perforation, while having a much smaller cross-sectional area, and therefore a greatly decreased resistance to flowing frac fluid.

Diverter 204 of FIG. 2C is shaped as an erythrocyte, which has its greatest thickness $T_2$ along its outer perimeter or edge, but has center region with having a smaller thickness $T_3$. The resistance to frac fluid flow of the erythrocyte-shaped diverter 204 is estimated to be about 20% of the resistance of the ball sealer 200.

Diverter 206 of FIG. 2D is shaped like a saucer, having a convex bottom surface 214 with a first radius and a concave top surface 212 with a second radius different than the first radius. In this embodiment, the radius of the concave top surface 212 is greater than the radius of the convex side 214 so that the sides converge and intersect at outer edge 216 of the diverter. The diverter 206 has an overall thickness $T_4$ measured vertically from a lowest point of the convex bottom surface 214 to edge 216. Depending on the thickness $T_5$ (the actual thickness of which may depend on the materials and expected pressures), is estimated to have approximately 10% of the resistance of fluid as that of the ball sealer 200.

Diverter 208 of FIG. 2E is shaped as a disk, with a generally consistent thickness $T_6$ across its width W. In example shown, its resistance to the flow of frac fluid is estimated to be about 8% of that of the ball sealer 200. If the thickness is decreased to $T_7$, as shown by the example diverter 210 in FIG. 2F, its estimated resistance to the flow of frac fluid drops to about 25% of that of the ball sealer 200.

The actual cross-sectional area of these diverters 202, 204, 206, 208, and 210 may vary from each other, even if intended to seal the same sized perforations. The exemplary diverters of FIGS. 2B-2F have flat to curved surfaces to facilitate forming a temporary seal of the perforations. Furthermore, a diverter is constructed to be strong enough to seal the perforation without failing under the differential pressure across the diverter (the pressure acting against the surface of the diverter facing the inside of the casing less the pressure acting against the surface of the diverter facing the perforation) to which it is expected to be subject when seated on a perforation. The differential pressure will be the difference between the pressure of the frac fluid on the diverter inside the casing, acting against the diverter when sealing a perforation, which is a function of the pumping pressure on the frac fluid and the hydrostatic pressure of the frac fluid within the casing, and any fluid pressure outside the casing. In one embodiment, each of the diverters 202 to 210 is capable of withstanding at least 5000 psi of differential pressure without failing. In another embodiment, each diverter can withstand a differential pressure of at least 7500 psi without failing. In yet another embodiment, each diverter can withstand a differential pressure of at least 10,000 psi without failing. Furthermore, a diverter may, optionally, have a flexible and durable surface or coating to enhance sealing of the perforations. The diverters 202 to 210 may be partly or entirely constructed out of material or materials that allow them to be flexible, further enhancing their ability to form a seal over perforations 112. In some embodiments, diverters 202 to 210 may be constructed out of a composite material, which can be stronger and lighter than steel.

The shapes of diverters 202 to 210, particularly diverters 202, 204 and 206, allow them to be hollow to increase their displacement without increasing their weight. Therefore, the diverters may have a weight that is heavier, lighter or equal to the weight of its displacement of frac fluid. The embodiments of diverters 202, 204 and 206 are shown in figures as being hollow or at least having a partially unfilled cavity. However, in alternative embodiments, these diverters could be made solid or can include other apparatus embedded within the outer walls of the diverter, as detailed later starting with FIG. 7. The disk and wafer shaped diverters will be strong and lightweight without necessarily being hollow, but again may include internal apparatus as detailed later.

Referring briefly back to FIG. 1, frac fluid is shown being pumped downhole from the well head 102 and into the wellbore 106, as indicated by the arrows with the wellbore 106. At this point, pumping has continued long enough to begin to fracture parts of the formation 110. The frac fluid is shown flowing into perforations 112 associated with relatively larger fractures 116, indicating that those parts of the formation have been stimulated. The large fractures are in zones or areas of the formation with relatively high permeability. The less developed fracture 118 is intended to illustrate an area of less permeability that has not yet completed fracturing. The other perforations have little to no fracturing of the formation next to them. Those areas of the formation have lower permeability and are not receiving enough frac fluid to start to fracture because it is flowing mostly into the parts of the formation with higher permeability.

Once some of the most permeable areas of the formation are approaching full stimulation, a predetermined number of thin or low profile diverters, such as any one or more of the types shown in FIGS. 2B-2F, are introduced at or near the well head into the flow of frac fluid entering the wellbore, without stopping pumping of frac fluid and sand. These diverters are intended to temporarily seal only those perforations next to areas within the formation that have been fully stimulated—those, for example, next to fractures 116—and thus divert frac fluid and sand to less fractured or yet-to-be fractured areas of the formation.

Figure 4:
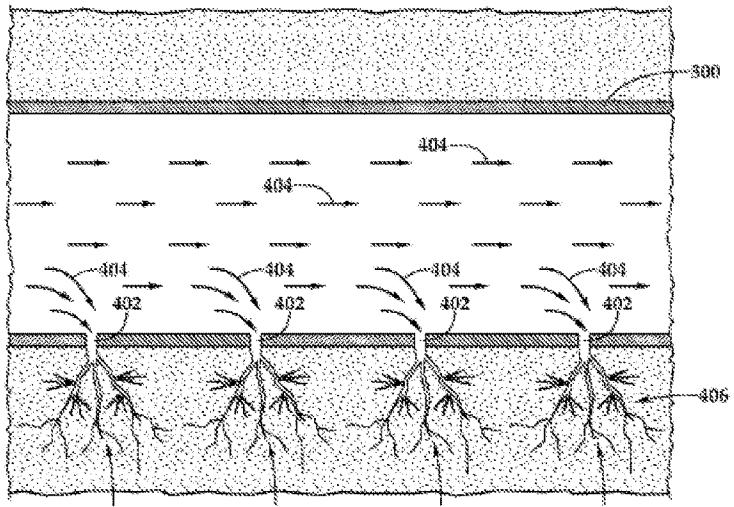
FIG. 4 illustrates the small section of a representative wellbore downstream of the representative wellbore shown in FIG. 3, with perforations formed therein and frac fluid flowing through the wellbore and perforations into the adjacent formation to cause fracturing.

Referring now to FIGS. 3 to 6, FIG. 3 illustrates a small section 300 of a horizontal wellbore casing upstream of the section 300 of casing with perforations (see FIG. 4), with flow arrows 302 indicating the direction of fluid flow downhole. The flow arrows 302 indicate how fluid flows in unperforated casing before reaching the perforated casing 300 shown in FIG. 4. FIG. 4 shows multiple perforations 402, after frac fluid has begun to be pumped under high pressures and at high flow rates downhole and through the wellbore. The flow of frac fluid is indicated by flow lines 404. All of the perforations are not sealed and therefore open. The pressurized frac fluid flows into the perforations adjacent to the areas or zones of the subterranean formation 406 where it is most permeable, as shown by directional lines 404. In the figure the perforations are adjacent to rock having, essentially, the same amount of permeability. Thus, in this example, it is shown flowing into all of the perforations. Although not shown, frac fluid, and thus also sand or acid, is not flowing, or flowing at lower rates, into perforations elsewhere within the segment of the wellbore 106 that is being fraced (a segment corresponds to one frac stage or length of wellbore undergoing a fracing operation) that are adjacent to less permeable parts of the formation. Thus, fractures 406 are being fractured first. Once the formation adjacent to perforations 402 are fully stimulated, meaning the frac fluid has fractured the subterranean formation 406 and the fractures 408 are packed with sand to hold them open, a predetermined number of low profile diverters, such as those shown in FIGS. 2B-2F, are pumped into the flowing frac fluid stream to seat and temporarily seal perforations 402 and thereby the frac fluid is redirected or diverted to the perforations within the wellbore adjacent to less permeable areas of formation to create fractures 118.

Figure 5:
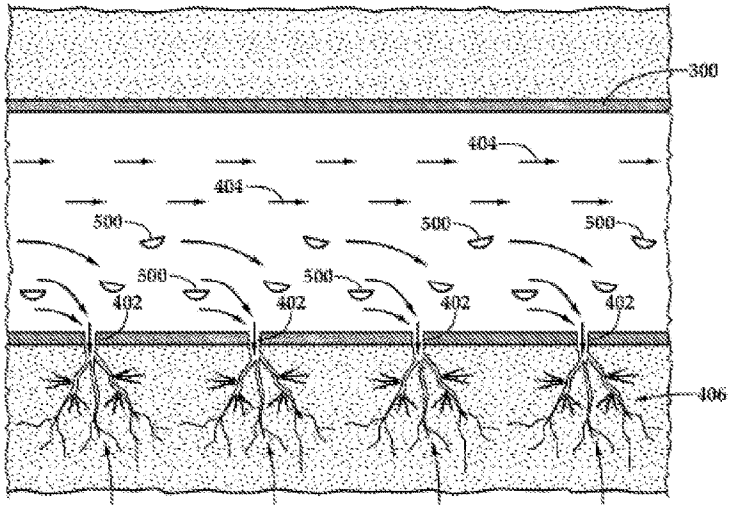
FIG. 5 illustrates the small section of a representative wellbore of FIG. 4, with the introduction of low profile diverters into the flow of frac fluid within the wellbore, before they seal perforations temporarily.
Figure 6:
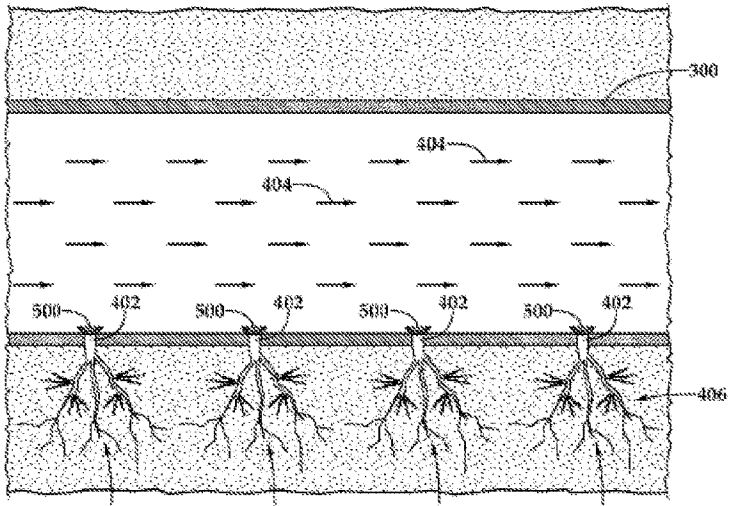
FIG. 6 illustrates the small section of a representative wellbore of FIG. 5, with the diverters previously introduced into the flow of frac fluid sealing perforations adjacent to stimulated formations.

In FIG. 5 the low profile diverters 500, which in this example are saucer shaped but can be any of any low profile shape capable of sealing against the perforations, are shown entrained in the flow of frac fluid and being moved toward perforations 402 by the flow of the frac fluid and sand into the perforations. In FIG. 6, the low profile diverters are shown seated on the openings of the perforations, engaging the edges of the perforations and thus temporarily sealing the perforations against substantial frac fluid flow. (A small amount of leakage may occur even when sealed). The high pressure of the frac fluid within the wellbore pushes against the seated diverters with sufficient force to keep them in place while the frac fluid flows past them, as indicated by the frac fluid flow lines 404 in the figure. Because of the low profile of the diverters, the frac fluid moving at a high rate within the wellbore is less likely to dislodge the low profile diverters as compared to conventional ball sealers.

Each diverter should temporarily seal one perforation, and only a perforation that has likely been stimulated with frac fluid and sand or acid, assuming that the diverter is introduced into the frac fluid flow at the right time. The number of diverters that are introduced into the flow of frac fluid is less than the number of perforations being stimulated. The pumping of the frac fluid continues and, after a period of time, an additional selected number of additional diverters can be introduced into the flowing frac fluid stream to temporarily seal some, but not all, of the remaining perforations. This process of continuing to pump frac fluid for some period of time before introducing a selected number of additional diverters is repeated as many times as necessary to selectively and progressively frac less permeable parts of the formation, until all of the volume of frac fluid with sand and the number of diverters designed and purchased for the job have been essentially depleted by pumping indicating that the stimulation of all perforations have been reasonably completely.

Use of low profile diverters as described above allows for the number of frac stages to be reduced, and possibly eliminate the need for frac stages, even for wells with relatively long wellbores, even for long laterals that require fracturing at very high rates and pressures, as compared to current methods that do not make use of low profile diverters.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

Figure 7:
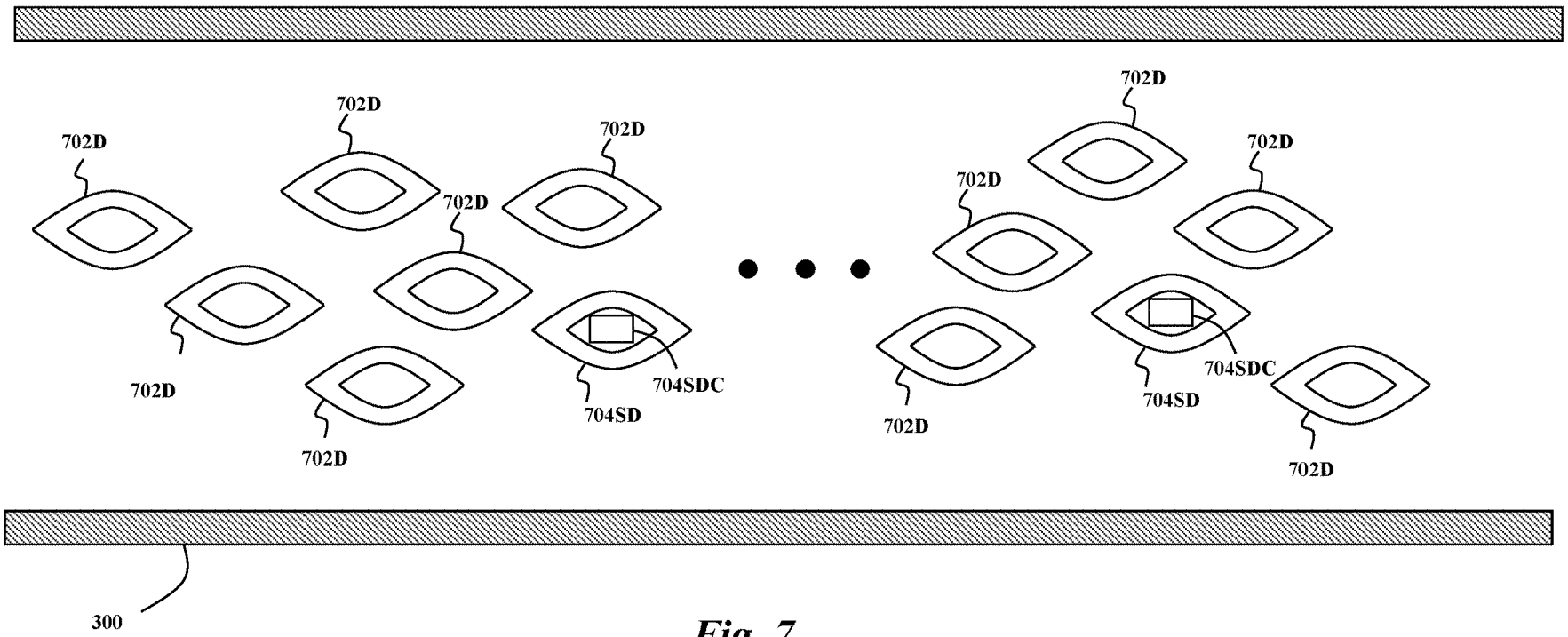
FIG. 7 illustrates a plurality of diverters shown flowing through the interior of a horizontal wellbore casing, including smart diverters having associated processing functionality.

FIG. 7 illustrates a plurality of diverters shown flowing through the interior of the section 300 of a horizontal wellbore casing, where by way of example the outer shape of the diverters are that of diverter 202 from FIG. 2B. Of the total diverters shown in FIG. 7, the majority are indicated as diverters 702D, taking the same form as shown earlier. However, a minority (e.g., 1 in 10) of the diverters introduced into the interior of the section 300 are, in a preferred embodiment apparatus and methodology, enhanced to provide what will be referred to herein as a smart diverter, hence shown in FIG. 7 as a smart diverter 704SD. Thus, as diverters are introduced into the wellbore casing, such as through a manifold of well head 102, diverter distribution information may be obtained and maintained, including the number of total diverters introduced into the wellbore, the number of those that are smart diverters or have some other varying attribute (e.g., shape/profile), and the time of entry of each (or some) of the diverters. Each smart diverter 704SD has additional apparatus affixed to the diverter, and preferably within (i.e., encased or enveloped within) the outer walls of the diverter, providing various additional functionality to the diverter beyond the ability to fill a perforation in the wellbore interior. Thus, recalling that the earlier description indicated that preferred embodiment diverters have an interior that is hollow or filled, preferably a smart diverter core 704SDC is provided within the interior of selected ones of the diverters, either in the hollow space or encapsulated or otherwise positioned in the diverter interior, thereby providing the smart diverter 704SD. As detailed below, therefore, additional functionality may be provided by the smart diverter 704SD, either as it travels with the frac fluid and/or once the smart diverter 704SD is seated into a well casing perforation. Including smart diverter 704SD along with normal diverter 702D, in a same frac fluid stream, should result in the smart diverter core 704SDC capturing all frac data as incurred by the smart diverter 704SD.

Figure 8:
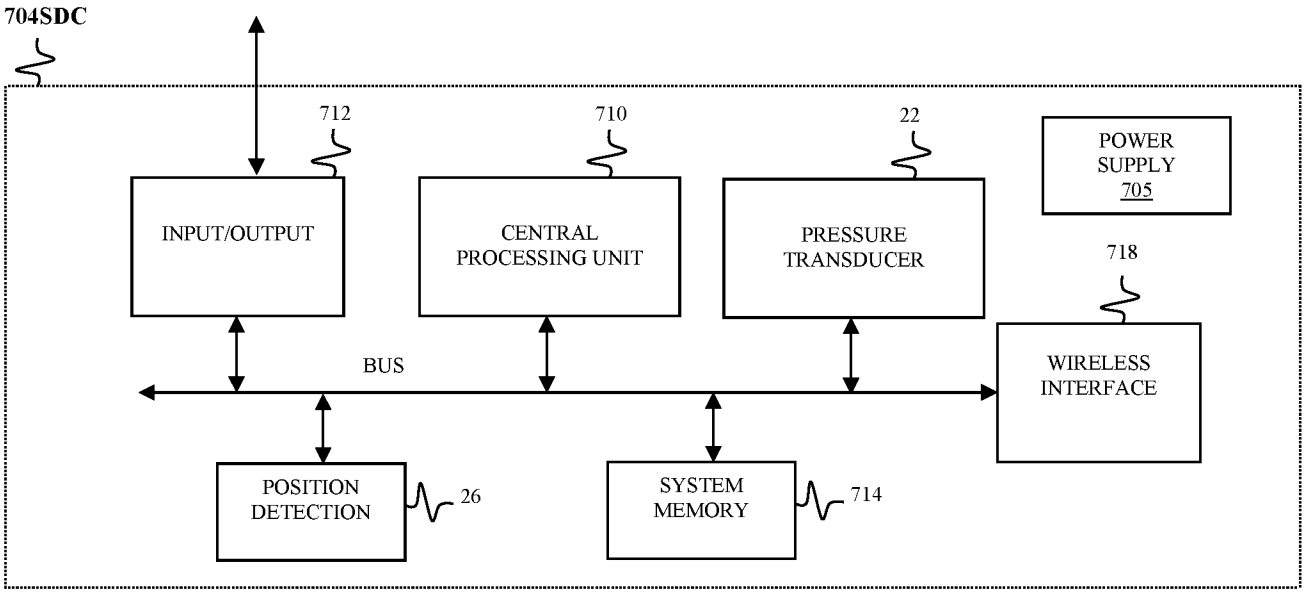
FIG. 8 illustrates an electrical/functional block diagram of a preferred embodiment implementation of the smart diverter core 704SDC from FIG. 7.

FIG. 8 illustrates an electrical/functional block diagram of a preferred embodiment implementation of the smart diverter core 704SDC from FIG. 7. The core 704SDC is in part a computational device, and it is noted in this regard that contemporary technology now has offerings of computational cores and ancillary items with a form factor as small as one millimeter cubed. For example, so-called smart dust technology proposes millimeter-scale self-contained microelectromechanical devices that include sensors, computational ability, bi-directional wireless communications technology, a power supply and the ability to self-organize into ad hoc networks, and currently advertised is a Michigan micro-mote that proposes such a device. Toward this end, therefore, the blocks of FIG. 8 illustrate preferred embodiment functionality to be implemented in such a device and in connection with the smart diverter core 704SDC. With these blocks, as further detailed below, as a diverter enters and then travels inside the wellbore 106, data may be captured and stored/communicated, so as to further enhance the fracing methodology, including but not limited to reducing the number of necessary fracing stages, thereby drastically reducing cost and time to production.

Looking in more detail to FIG. 8, the core 704SDC has an internal power supply 705 (e.g., lithium or other battery) and also includes a central processing unit 710, coupled to a system bus BUS. Also coupled to the system bus BUS is an input/output (I/O) interface 712, which may communicate with peripheral I/O functions outside of the core. Preferably, with the core 704SDC internal to the diverter, then I/O is with other devices also internal to the diverter, although such additional devices are not shown. Such devices are contemplated, however, and could replace or augment those shown in FIG. 8. Additionally, also contemplated is that prior to the diverter being introduced into the wellbore 106, the I/O could physically be through the diverter body. The central processing unit 710 refers to the data processing capability of the core 704SDC, and as such may be implemented by one or more CPU cores, co-processing circuitry, and the like. The particular construction and capability of the central processing unit 710 is selected according to application needs, such needs including, at a minimum, the carrying out of the functions described in this document, and also including such other functions as may be desired. The core 704SDC also includes a system memory 714 is coupled to system bus BUS, and it provides memory resources of the desired type useful as data memory for storing input data and the results of processing executed by central processing unit 712, as well as program memory for storing the computer instructions to be executed by central processing unit 712 in carrying out those functions. Of course, this memory arrangement is only an example, it being understood that system memory 714 can implement such data memory and program memory in separate physical memory resources, or distributed in whole or in part outside of the core 704SDC.

The core 704SDC also includes a wireless interface 718 that is conventional in nature of an interface or adapter by way of which the core 704SDC may communicate with other wireless devices, such as in a local sense or a more extensive network, with an example provided below in connection with FIG. 8. Thus, the wireless interface 718 may include various types of radio communication apparatus, including WiFi, Bluetooth, and other known or ascertainable communication protocols and standards. In this regard, also in the preferred embodiment, apparatus (described later) are contemplated to poll or otherwise communicate with each smart diverter 704SD, including any of when it enters, as it travels within the wellbore 106, and/or once it is seated in a perforation. Such apparatus may be independent of the wellbore 106, for example by positioning a sonde, transceiver, or the like down and through the wellbore 106 so that as the sonde is proximate, or within some communication range of a smart divert 704SD, either unidirectional or bidirectional communications are facilitated beyond the two, an example of which is detailed later. Such a sonde, for example, may be controlled and/or in communication with equipment 105, where the steering and positioning of the sonde, including its depth along the wellbore 106, may be controlled and/or evaluated. In this manner, in addition to position sensing by a smart diverter 704SD, the sonde and/or equipment 105 may further detect a location (or approximate location) of a diverter once it is secured in a perforation, thereby further being able to communicate pressure and other information associated with that determined position.

In addition, also contemplated in certain embodiments is using a portion of the wellbore as part of the communication path; for example, as earlier mentioned, part of the casing may be steel, in which case electromagnetic waves may be made to use the steel to communicate with diverters using the steel, or possibly other structures, as a waveguide in communicating signals from a smart diverter to other locations within the wellbore, or even along the wellbore, either directly or via intermediately-positioned other smart diverters, to the top and out of the well.

In all events, interface 718 provides remote access between the smart diverter 704SD and other (e.g., network) resources, which can include other computation devices such as associated with equipment 105 at or above the surface, below which the well is formed. In this manner, an operator may query or collect data from one or more smart diverters, whereupon the operator, either directly or with the use of additional software of the like, can interpret data taken and communicated by, one or more diverters, so as to modify the fracing process, particularly, for example, with respect to reducing the number of fracing stages.

Further in a preferred embodiment, the smart diverter core 704SDC includes a (or more than one) pressure transducer (s) 720 or comparable device for detecting pressure changes, including measuring acoustics and acoustical changes, and possible correlations between acoustics and pressure changes. As shown, the pressure transducer 720 is integral to the core 704SDC, but alternatively such a transducer may be a separate apparatus (e.g., communicating via the I/O 712), again internal to the diverter, but otherwise in communication with the processing and memory functionalities of the core. In this regard, the pressure transducer(s) 720 is preferably configured and controlled to capture and store and/or communicate one or two pressures, namely: (i) dynamic pressure, that is, the increase in a moving fluid's pressure over its static value due to motion; and (ii) differential pressure once the diverter is situated in a perforation, which pressure as defined earlier is the pressure between the frac fluid within the wellbore and the formation in this regard, also contemplated is that the pressure transducer(s) 718 may include some manner of directionality, for example, relative to the shape of the transducer so as to measure pressure on one side of the transducer (e.g., facing the fluid interior of the wellbore) versus the other side of the transducer (e.g., facing the rock formation external from the wellbore). Additionally, detected changes in pressure may be correlated to known or suspected events near the detecting sensor(s), such events including an initial breakdown of the rock proximate a frac stage as well as ongoing above-threshold pressure changes that can indicate advancement of the rock formation breakdown as it accepts more and more fluid/proppant and pressure changes as diverters seat in respective perforations.

Lastly, the smart diverter core 704SDC may include a position detection block 722. Position detection block 722 is intended to include functionality to assist with the diverter communicating its position either as it travels within and/or once is seats in a perforation within the wellbore 106. For example, the position detection block 722 718 may include some form of global positioning system ("GPS") functionality, although it is recognized that the ability to directly communicate with the GPS system would be limited at the underground depths of a wellbore. Thus, block 722 may include the ability to capture position at the surface point of entry into the wellbore, with additional dead reckoning features (e.g., international navigational speed and direction measures) from which position can be further estimated as the diverter travels within the wellbore 106.

According to a preferred embodiment, by way of example, the system memory 714 stores computer instructions executable by the central processing unit 712 to carry out the functions described in this document. These computer instructions may be in the form of one or more executable programs, or in the form of source code or higher-level code from which one or more executable programs are derived, assembled, interpreted, or compiled. Any one of a number of computer languages or protocols may be used, depending on the manner in which the desired operations are to be carried out. For example, these computer instructions for creating the model according to preferred embodiments may be written in a conventional high level language, either as a conventional linear computer program or arranged for execution in an object-oriented manner, or in numerous other alternatives including those well-suited for web-based or web-inclusive applications. These instructions also may be embedded within a higher-level application. In any case, it is contemplated that those skilled in the art having reference to this description will be readily able to realize, without undue experimentation, the preferred embodiments in a suitable manner for the desired functionality. These executable computer programs for carrying out preferred embodiments may be installed as resident within the core 704SDC, or alternatively may be resident elsewhere and communicated to the core.

Given the preceding, the present inventors have provided improved fracing apparatus and methodology. For example, preferred embodiments improve apparatus in permitting extensive downhole pressure measurements for use, as an example, during fracing. Thus, a preferred embodiment method would facilitate determining breakdown pressure, which presently may be detected at the surface, but with the preferred embodiment may be more accurately determined by use of one more distributed pressure sensors in the wellbore. Moreover, with the pressure sensing associated with diverters, whether those diverters are spherical as in the prior art or non-spherical (e.g., in FIGS. 2B-2F), pressure is knowable in combination with the diverting functionality, and it is anticipated that more efficient manners of fracing may be conducted by having more precise, and more accurately position-fixed located (e.g., by GPS measure; by smart diverter communication), measures of pressure and rapid pressure changes (e.g., pressure "spikes"), and temperature, as the fracing process is performed. For example, such pressure measures may be used to control fluid flow rate, fluid pressure, timing for entry of diverters, and determination of when a stage has been sufficiently fraced so as to complete that stage and start a next stage (or even potentially to reduce or eliminating staging altogether). Indeed, also contemplated is that the information provided by smart diverters, and transmitted back to the top of the wellbore, may be received and processed by computational equipment. Accordingly, such information may be sufficient to reduce or eliminate certain human operations and decisions currently required in fracing stages, including for example the beginning and ending of frac stages, the admission of more diverters (smart or normal), and the control of pressures, flows, and other materials (e.g., proppants) flowed into the wellbore, thereby speeding the process and reducing possibilities of human error and resource needs.

Figure 9:
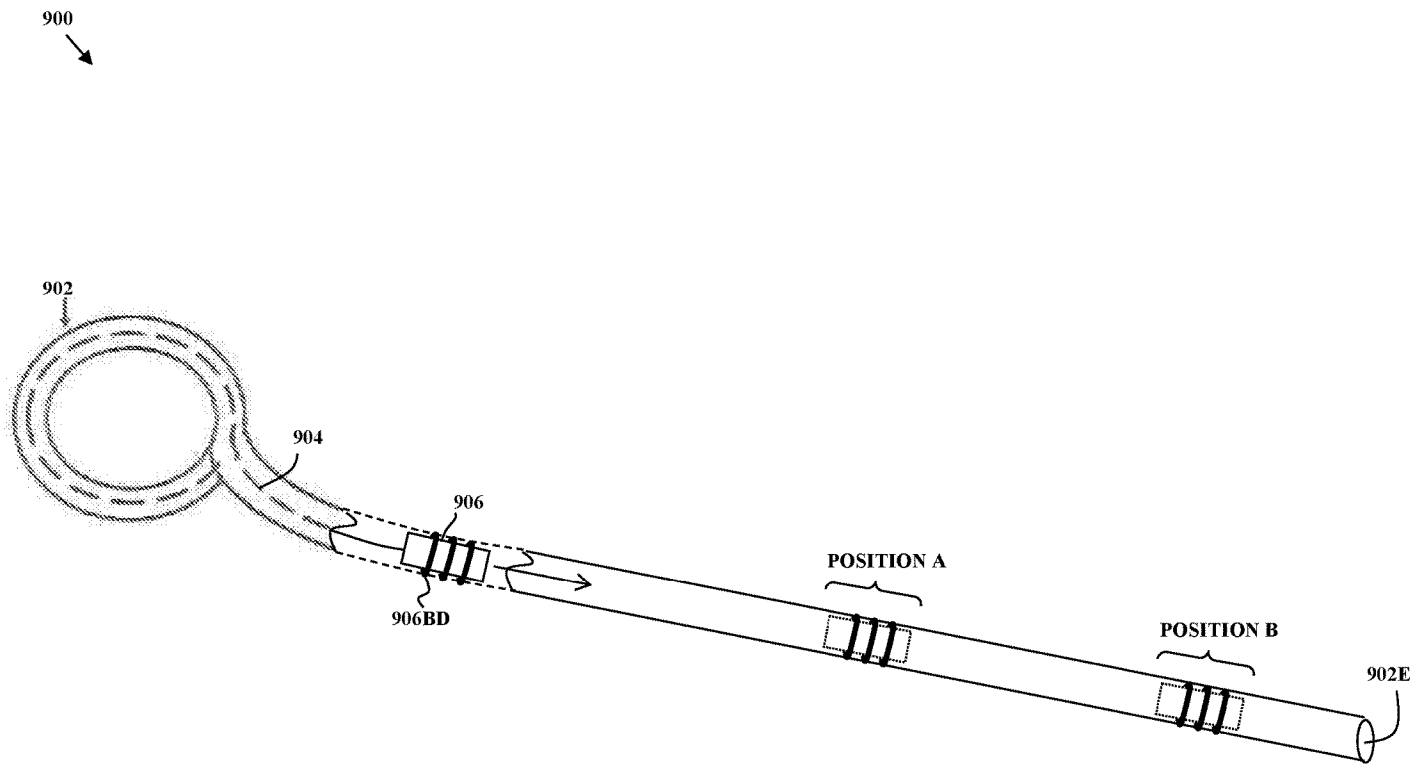
FIG. 9 illustrates a downhole smart diverter interrogation system 900.

FIG. 9 illustrates a downhole smart diverter interrogation system 900. The system 900 includes coiled tubing 902, which is well-known in the art as a continuous length of small-diameter pipe (e.g., steel) and related surface equipment (not shown) for working on live, producing wells. The tubing 902 is commonly delivered near the well head, and from a reel on which the tubing is spooled. The tubing 902 is drawn from the wheel and fed down into a wellbore 106 (see FIG. 1), for example, for delivery of tools or retrieval of items in the wellbore 106. In the illustrated embodiment, however, an electrical cable 904 is located internally within the tubing 902, and communicates with an interrogation transceiver 906. The transceiver 906 includes adequate circuitry, capable of operating within the well environment, and implemented in a desirable level of hardware and software. Further, the transceiver 906 is for communicating with smart diverter cores 704SDC that have been displaced down the wellbore 106, as described above. For example, the transceiver 906 may communicate wirelessly to cores 704SDC, along one or more frequencies (e.g., channels) to communicate either singularly or with multiple cores 704SDC at a time, or quickly switching to communicate (e.g., frequency scanning, hopping, changing, or the like) so as to communicate with different ones of the cores 704SDC, once those cores are either moving, or have affixed into a respective perforation.

In example embodiment, the transceiver 906 also includes apparatus for advancing the transceiver 906 to desirable positions within the tubing 902. For example, the end 902E of the tubing 902 may be displaced all the way down the wellbore 106, or to a known location within the wellbore 106. Thereafter, the transceiver 906 may be advanced to certain positions within the tubing 902, so that positional information is thereby known of the transceiver 906 (e.g., from the length of cable 904, the length of tube 902, dead reckoning technologies, and the like); accordingly, any cores 704SDC that may then communicate with the transceiver 906 also may be position-determined, relative to the known position information of the transceiver 906. For positioning the transceiver 906, in the illustrated example, one or more pressure-fitting bands 906BD are affixed to the outer perimeter of the transceiver 906, so that a seal is formed as between the outer portion of the bands 906BD and the inner diameter of the tubing 902. In this manner, as liquid is pumped downhole, that liquid may enter the interior of the tubing 902, and with the seal provided by the bands 906BD, the liquid pressure will advance the transceiver 906 downward through the interior of the tubing 902, thereby pumping the transceiver 906 to a desired stopping point in that interior. As examples, FIG. 9 illustrates potential positions A and B, such that the pumping pressure may be reduced when the transceiver 906 reaches either of those positions, in order to stop the transceiver 906 from further advancing along the interior of the tubing 902. Each potential position may correspond to a location within the wellbore 106 where the well casing has been perforated, with the expectation therefore being that diverters, including cores 704SDC, are likely to have sealed those perforations. Accordingly, with the transceiver 906 at position A or position B, nearby cores 704SDC may be interrogated, so as to record position and pressure data and other data consistent with the earlier description. Such data may be stored within the transceiver 906 and/or communicated (e.g., real time) via the cable 904 to data processing device at the far end of the cable, such as in equipment located atop thee wellbore 106. Lastly, the transceiver 906 may be advanced back toward the wellbore, either by pulling on the cable 904 (or, a separate physical cable parallel to cable 904, if the electrical connectivity of the cable 904 would not withstand the pulling force), or by retracting the tubing 902. Indeed, with the ability to retract the transceiver in this manner, another contemplated alternative for positioning the transceiver 906, and thereby knowing that position, would be to advance the transceiver 906 to the tubing end 902E, and then retract the transceiver a retracted distance inside the tubing 902 a known distance, with the position thusly being the position of the tubing end 902E within the wellbore, minus the retracted distance.

Figure 10A:
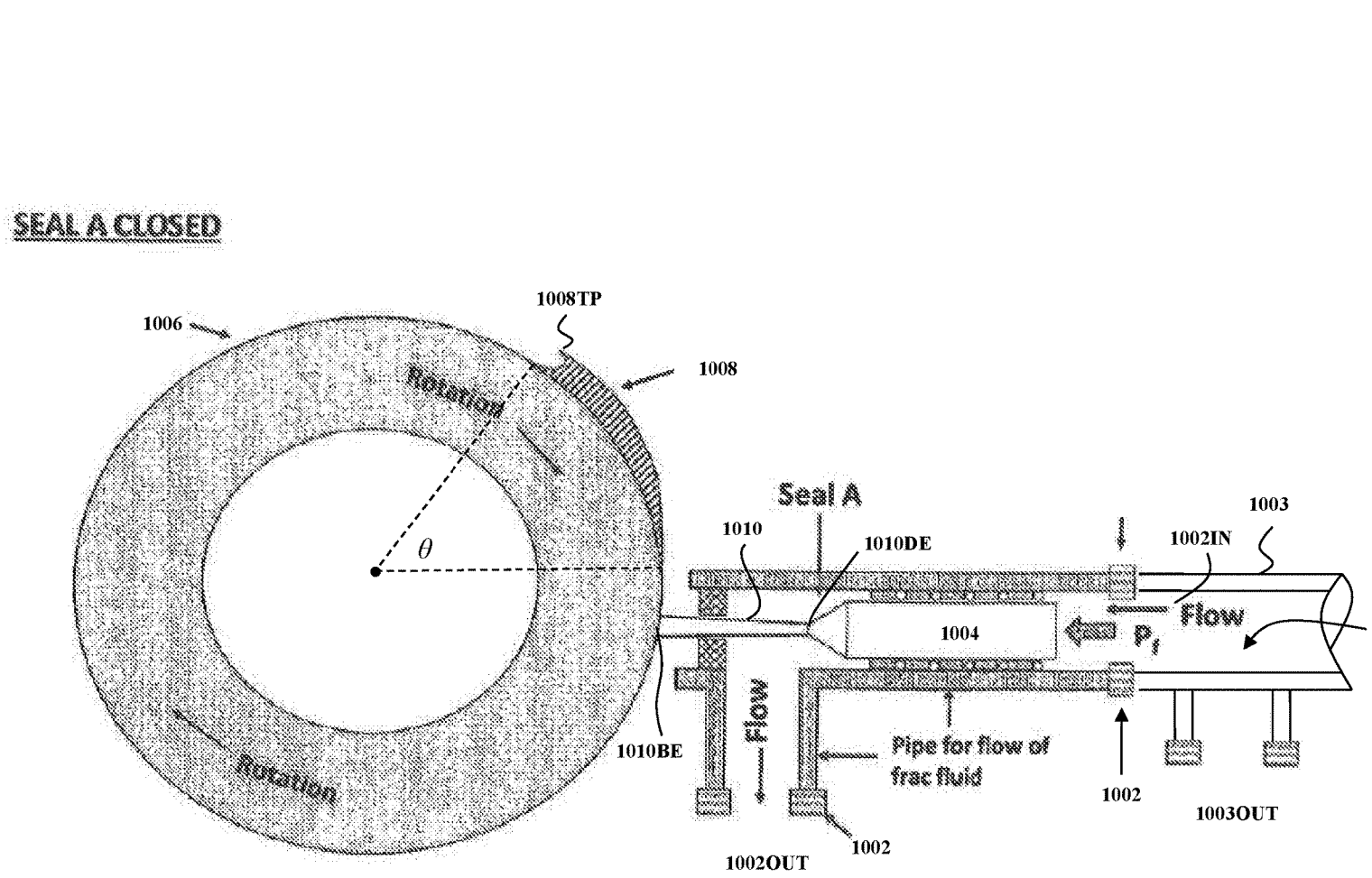
FIGS. 10A and 10B illustrate a pulsing fracing system 1000.
Figure 10B:
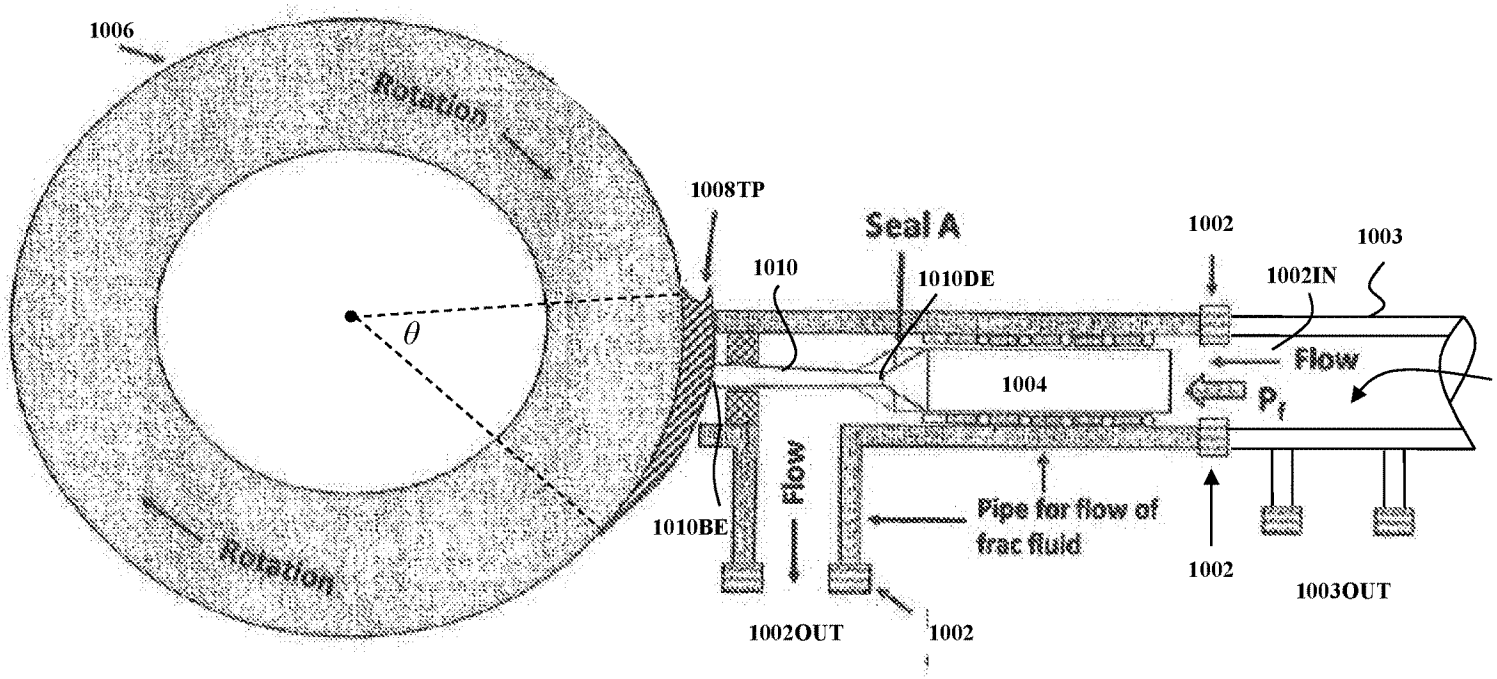

FIGS. 10A and 10B illustrate a pulsing fracing system 1000. As background, during the fracing phase to perforate the well, it has been proposed in the art to cycle the downhole pumping fluid engine(s) on and off to create variations in pumping pressure, seeking to more effectively perforate the rock formation proximate and outside the well casing in desired locations (i.e., to enhance porosity and permeability). Such cycling, however, could create considerable cost and durability risks, and potentially increase safety concerns, in connection with the operation of such engines, and the associated high-pressure and flow-rate fluid connections to those engines. The system 1000 contemplates an improved alternative, as is described below, and without requiring the sudden turning on and off of the frac fluid pumping engine(s). Indeed, decades ago fracing was performed using explosives (e.g., nitroglycerine). Such approaches were effective in creating what was believed to be complex fractures in the rock formation in the areas of the wellbore where the explosion occurred, but of course use of explosives was very dangerous, potentially toxic, and subject to limited control. Eventually such explosives were replaced with more controllable techniques, involving very large pressures and flow rates, as is common in modern fracing. However, example embodiments are provided below and that include pulsing apparatus in various alternative forms, each providing pressure changes in short duration spikes (e.g., 100,000 psi or greater, for example several hundreds of thousands). Such pressure spikes may match, if not exceed, the fracing pressures created previously by explosives, yet in a safer and more controlled environment, also thereby achieving highly complex fractured rock systems ("HCFS") and flow paths for subsequent oil and gas recovery. Still further, example embodiments provide the pulsing in repeated fashion, whereby it is expected that ongoing pulsing can have a cumulative effect to further enhance the fracing effect of rock formations. For example, pulsing essentially pulverizes/shatters the surrounding rock formation by the ongoing rhythmic heartbeat-like operation of ongoing and periodic high pressure pulses. Also contemplated is that pulsed spikes may be achieved while the frac fluid pumping engine(s) continue to provide a constant (or near constant) fluid pressure to the system 1000, whereby such pressure is augmented with additional apparatus, as may be implemented in a bypass system, as further described below.

The system 1000 includes various apparatus, which in one example embodiment, may be housed in a unitary and moveable structure (e.g., with a cabinet or other frame, and wheels). In this manner, the system 1000 may be affixed to an existing frac pump fluid system and, as will be detailed, can periodically bypass the standard frac fluid flow from pump engine(s) to the wellbore, without otherwise changing standard fracing process. Note that system 1000, as a bypass coupling, may be temporarily connected to the regular pump engine(s) or may be left connected on a longer term basis, so as to provide intermittent or continual pulsing over a long duration, such as full-time during the fracing stage of the well. In more detail, the system 1000 includes a bypass manifold 1002, for coupling to the existing frac fluid piping 1003. As a bypass connection, therefore, either the existing frac fluid piping 1003 provides an outlet 1003OUT by which normal fluid flow continues to the wellbore (not shown) or, alternatively, the system 1000 may be coupled by the bypass manifold 1002 to the piping 1003 and, with outlet 1003OUT closed, then the flow continues to the system 1000, and the system 1000 may be enabled/operated intermittently to provide sharp pressure pulses in downhole fracing pressure, when desired. Thus, the system 1000 is intended to periodically bypass the standard frac fluid system, so that when system 1000 is operating and frac fluid flows through it, it will provide sharp pulse transitions in the fluid pressure flow, whereas when the bypass is not operated, the frac fluid may flow directly from the fracing engine(s) to the wellbore, the latter according to techniques known in the art. Accordingly, the manifold 1002 includes sufficient couplings, connections, and the like so as to couple to the fluid piping that receives pressurized frac fluid from a frac fluid engine (not shown). Frac fluid flow thusly couples, at the frac pumping pressure Pf, to an inlet 1002IN of the manifold 1002 and, when valve 1004 is open as described below, exits the manifold 1002 in pulsed pressures from an outlet 1002OUT. A reciprocating valve 1004 is enclosed within the manifold 1002, and may be implemented in various forms, so as to preclude a fluid flow path when the valve 1004 is in the closed Seal A position as shown in FIG. 10A, but alternatively to enable the fluid flow path when the valve 1004 is in the unsealed (open) position, as shown in FIG. 10B. The valve 1004 may, therefore, include a main member and various seals, guides, bearings, seating and the like, at either or both of its perimeter and ends. Further, as shown in FIG. 10A, the frac fluid flow is in a direction that, without an opposing force, maintains the valve 1004 in the closed Seal A position.

The system 1000 also includes apparatus for abruptly opening and closing the valve 1004, so as to periodically provide pressure fluid spikes or pulses from the outlet 1002OUT, with an open position of the valve 1004 illustrated in FIG. 10B. In the example embodiment as shown in both FIGS. 10A and 10B, such apparatus includes a flywheel 1006, which is intended to be an appropriately-sized and weighted/balanced wheel, having a generally and mostly circular outer perimeter. The flywheel 1006 is rotated by an engine or the like (not shown), at a speed to be determined based on considerations provided to, or by, one skilled in the art. In the illustrated example, the flywheel 1006 is shown to rotate clockwise. Along the generally-circular outer perimeter of the flywheel 1006, also included is one (or more than one) wedge 1008, which extends along an having an arc central angle θ, where the central angle θ also may be determined by one skilled in the art. The wedge 1008, for the duration of the central angle θ, is such that the radius of the flywheel 1004 continuously increases until a termination point 1008TP of the wedge 1008, at which point the radial increase is markedly disrupted and returned to the circular radius of the flywheel 1006. The system 1000 also includes a rod 1010. The rod 1010 has a bearing end 1010BE that bears against the outer perimeter of the flywheel 1006 and a distal end 1010DE that either contacts, or is connected or integral to, an end of the valve 1004.

FIG. 10B illustrates the operational impact of the system 1000. Specifically, as the flywheel 1006 rotates, the wedge 1008 correspondingly advances along the circular arc, for example to the position shown in FIG. 10B (the wedge position from FIG. 10A is shown in phantom, in FIG. 10B). As the bearing end 1010BE of the rod 1010 begins to incur the wedge 1008, the increasing radius provided by the wedge 1008 causes a linear displacement of the rod 1010, and correspondingly a linear displacement of the valve 1004. The linear displacement of the valve 1004 causes it to move to an unsealed/unseated position, as shown in FIG. 10B, thereby allowing frac fluid to flow through the manifold 1002. Further, with the pressure $P_f$ having been stored behind the valve 1004 prior to the unseating movement (and that pressure retaining the valve 1004 in a seated position), the abrupt opening of the valve 1004 causes a pressure spike, from no pressure to the sudden release of pressure, to be delivered through the manifold 1002 into the wellbore, via the outlet 1002OUT. Further, as the flywheel 1006 continues to rotate, eventually the bearing end 1010BE of the rod 1010 will encounter the termination point 1008TP of the wedge 1008. After the termination point 1008TP rotates beyond the bearing end 1010BE, the bearing end 1010BE will return to bear against the otherwise-circular perimeter of the flywheel 1006, with the rod 1010 again being urged into that position by the pressure $P_f$ pushing inwardly against the valve 1004, and the valve 1004 pushing inwardly against the rod 1010. At this point, therefore, the valve 1004 is returned to a sealed/seated position, akin to that shown in FIG. 10A.

Figure 11A:
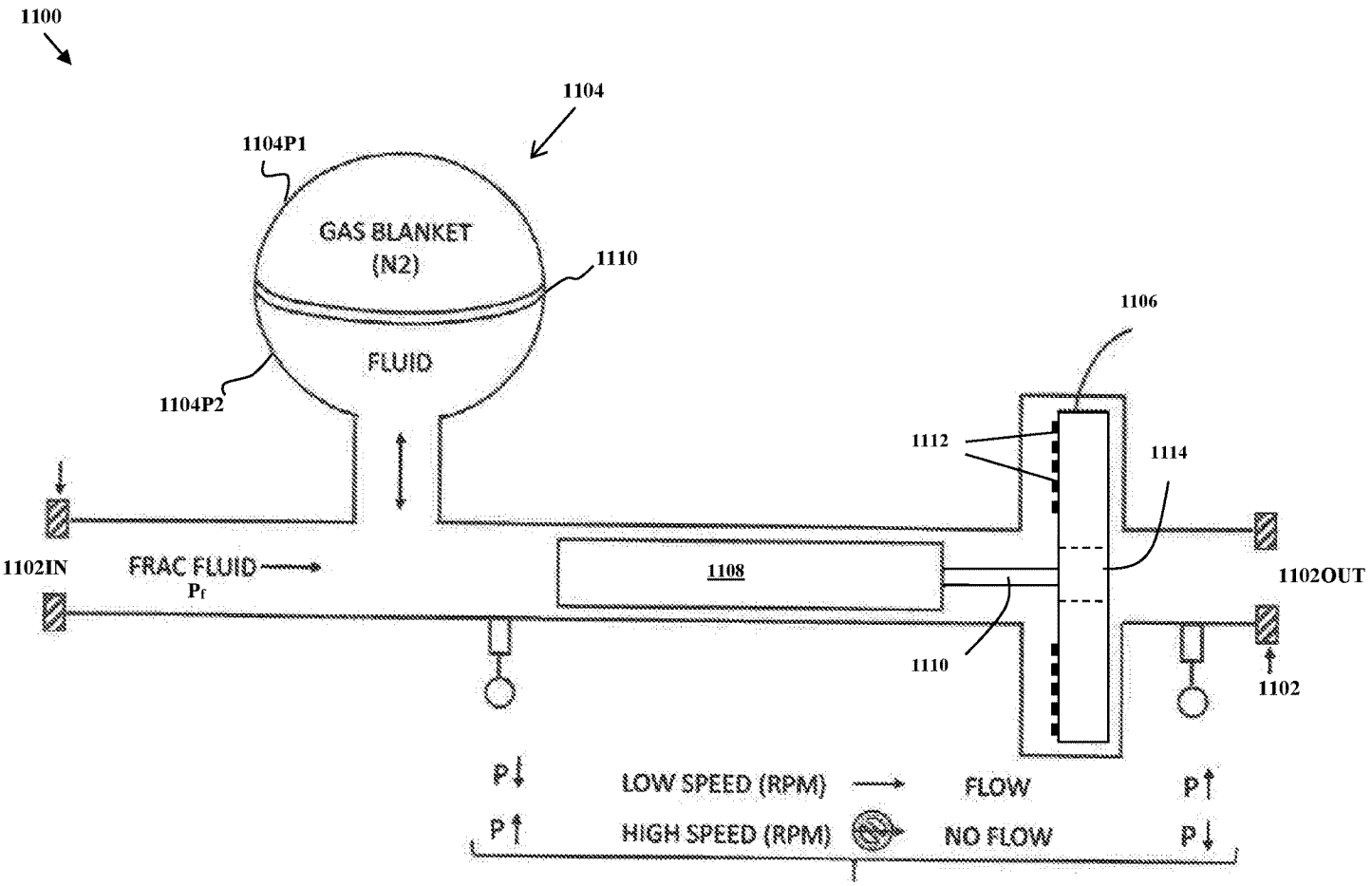
FIGS. 11A and 11B illustrate an alternative pulsing fracing system 1100.

FIG. 11A illustrates an alternative pulsing fracing system 1100, again with consideration to the prior discussion of perforating the well and proximate rock formation, without requiring the sudden turning on and off of the frac fluid pumping engine(s). The system 1100 includes various apparatus, also which in an example embodiment are housed in a unitary and moveable structure and that may be temporarily affixed to an existing frac pump fluid system to periodically bypass ordinary frac fluid flow to the wellbore. In more detail, the system 1100 includes a bypass manifold 1102, for coupling to the existing frac fluid piping, so that the system 1100 may enabled/operated intermittently to provide sharp downhole fracing pressure pulses. Thus, the system 1100 is intended to periodically bypass the standard frac fluid system, so that when system 1100 is operating and frac fluid flows through it, it will provide sharp pulse transitions in the fluid pressure flow, whereas when the bypass is not operated, the frac fluid may flow directly from the fracing engine(s) to the wellbore. Accordingly, the manifold 1102 includes sufficient couplings, connections, and the like so as to couple to the fluid piping that receives pressurized frac fluid from a frac fluid engine (not shown). Frac fluid flow thusly couples, at the frac pumping pressure $P_f$, to an inlet 1102IN of the manifold 1102 and may advance generally toward two different sets of apparatus: (i) a pressure bank 1104; or (ii) a rotating valve 1106, operated by a submersible variable high speed electric motor 1108. Each of these alternative paths is further discussed below.

Pressure bank 1104 is known in certain arts, as an apparatus in which fluid and gas are stored in a common tank (and separated from one another via a diaphragm 1110), sometimes for protective purposes. In the example embodiment, however, pressure bank 1104 is used in a dual cycle operation, a first pressure-storing cycle for storing frac fluid pressure and a second pressure-releasing cycle for releasing the frac fluid pressure. In this regard, a first portion 1104P1 of the volume of the bank 1104 includes a gas, such as nitrogen, enclosed by the diaphragm 1110. A second portion 1104P2 of volume of the bank 1104 receives frac fluid and its attendant pressure; hence, during the pressure-storing cycle, an increase in fluid to the portion 1104P2 displaces the diaphragm 1110 to compress the gas in the portion 1104P1 to essentially store pressure energy in bank 1104, and during the pressure-releasing cycle, a decreased pressure as described below permits the gas in the portion 1104P1 to expand so as to displaces the diaphragm 1110 and release the stored pressure in the bank 1104 into the manifold 1102.

Figure 11B:
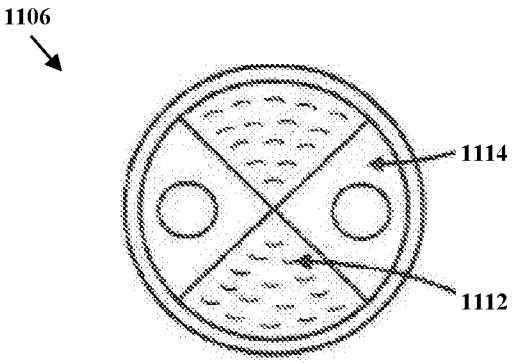

The rotating valve 1106 is shown in side view in FIG. 11A, and in frontal view that faces the motor 1108 in FIG. 11B. In the example embodiment, the valve 1106 has a circular outer perimeter and is connected by a shaft 1110 to the motor 1108. Accordingly, as the motor 1108 rotates, the rotational force is applied via the shaft 1110 to the valve 1106, so that it also rotates, per the speed of the motor 1108. On the pressure-receiving side (or face) of the valve 1106, there are located pressure control apparatus, for example: (i) a plurality of fluid diverters 1112, which may be shaped protrusions or the like; and (ii) one or more apertures 1114. The pressure control apparatus are included so that at low (or no) speed rotation of the valve 1106, fluid pressure inside the manifold 1102 passes through the apertures 1114 to the outlet 1102OUT, whereas at high rotational speeds of the valve 1106, the diverters 1112 disturb fluid flow in a manner to limit or prohibit the passage of fluid through the apertures 1114. Given these two speed-responsive functions, note therefore that: (1) during the pressure-storing cycle of operation, the motor 1108 rotates the valve 1106 at a significantly high enough speed so that little or no pressure passes through the valve 1106, thereby applying back pressure inside the manifold 1102 and adding pressure into the bank 1104; and (2) during the pressure-releasing cycle of operation, the motor 1108 rotates the valve 1106 at a low (or no) speed, so that pressure of the fluid passes through the valve 1106, and at the same time reduces pressure within the manifold 1102, so that also at this time pressure stored in the bank 1104 is transferred into the interior of the manifold 1102, thereby pulsing the pressure applied at the outlet 1102OUT. Accordingly, with sufficient timing to the starting and stopping of the motor 1108, pressure spikes may be generated at the outlet 1102OUT. Further, the time elapsed between the first and second cycles will establish the duration and magnitude of the pressure pulse generated, and continuous rotation can provide a periodic and repeatable pulse train.

Figure 12:
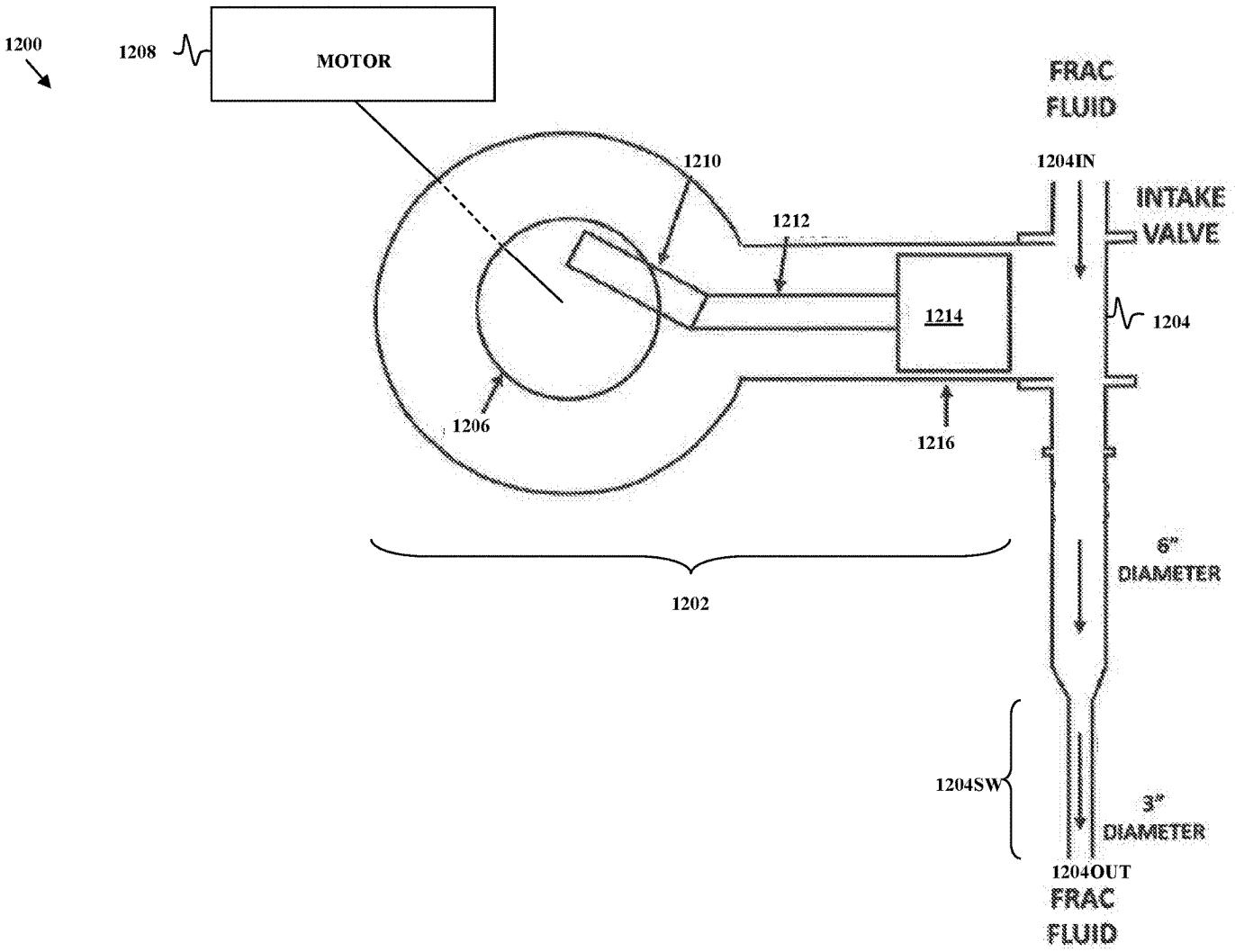
FIG. 12 illustrates a portion of another alternative pulsing fracing system 1200.

FIG. 12 illustrates a portion of another alternative pulsing fracing system 1200, with various considerations akin to systems 1000 and 1100, as well as the prior art described above. The system 1200 includes a piston compression apparatus 1202 that couples pressure into a fluid manifold 1204. Apparatus 1202 includes a rotating assembly such as a crankshaft 1206 operated by a separate rotational force (e.g., motor or pump 1208), and a tie rod 1210 is pivotally connected to the crankshaft 1206, away from the rotating axis of the crankshaft 1206, so that rotation of the crankshaft 1206 translates to linear motion of a piston rod 1212 connected to the tie rod 1210. More specifically, the linear motion is also guided in that piston rod 1212 connects to a piston 1214, which is fitted within (e.g., by piston rings) a pressure cylinder 1216. Accordingly, as the motor 1208 rotates the crankshaft 1206, the piston 1214 reciprocates within the pressure cylinder 1216, as in known in certain arts. Where system 1200 differs considerably from such arts, however, is the example embodiment uses either a single piston, or plural pistons, operating so that all pistons move with a same offset on the crankshaft 1206 (or with the same timing on other respective crankshafts). Thus, instead of having a total N number of pistons, each timed to move 360/N out of degrees with another of the other respective pistons, in the system 1200, all pistons are timed to reach their maximum stroke at the same time. Thus, in contrast to prior art piston-based engines that seek offset firing for efficiency and dampening, the system 1200 configuration and timing causes an abrupt pressure surge as each piston reaches its concurrent maximum stroke. Further in the system 1200, each pressure cylinder communicates with a common fluid path. For example, FIG. 12 illustrates the manifold 1204, in fluid communication with the pressure cylinder 1216. Preferably, all other such pistons (not separately shown) also fluidly communicate with the manifold 1204. Hence, frac fluid enters the manifold input 12041N and is subject to the cumulative pressure of all pistons reaching maximum stroke at the same time. Hence, a cumulative pressure spike is introduced into the manifold 1204 at this occurrence. Further, the manifold 1204 includes a swedged (reduced diameter) section 1204SW, further increasing the pressure of the spike that is formed by the concurrent top-cylinder reach of the collective pistons in the system. The spiked output is then provided at the outlet 1204OUT of the manifold 1204, and as was with above embodiments, may then be introduced into the wellbore, for purposes of pulsed fracing operations.

Various of the example embodiments include a manifold for introducing items in the wellbore, such as diverters, pressure spikes, and the like. In connection with any of such manifolds, example embodiments contemplate adapting the manifold to introduction of such items, and also retrieving data via or through the manifold in connection with pressure measurements made down the wellbore. Pressures are remarkably obtained, therefore, including pressure at: (i) formation break down, when the combined surface pump pressure plus the hydrostatic frac fluid column load (less the fluid column friction) exceeds the strength of the rock formation being fraced; (ii) rock fracture initiation or rock fracture extension; and (iii) the time a diverter seats on a perforation. Example embodiments then process such pressures, using appropriate computational systems such as a computer station proximate the top of the wellbore, for example included in the equipment 105. Such a computer station may operate alone, or in conjunction with other computer or data systems, including remote processing, as may be achieved via networking with other devices (e.g., mobile devices and networks, including cellular and the Internet, as examples). With such pressures and other information, including that regarding specific location of pressure within the well, adjustments may be made to timing to complete one stage and start another, and possibly eliminating numerous stages in the fracing process. Such elimination can have massive impact on fracing timing, the process, and the industry as a whole.

Given the preceding, while the inventive scope has been demonstrated by certain preferred embodiments, various alternatives exist. Some embodiments include manners of detecting pressure and other measures at vast distances into the wellbore. Other embodiments include manners of creating HCFS, through pulsing of the frac fluid, preferably without interrupting the operation of the fluid pressurizing engines. Indeed, combining these embodiments may allow for more efficient fracturing, versus contemporary approaches. For example, a same or greater level of fracing may be achieved, as compared to contemporary approaches, potentially in less time, with fewer human resources, fewer stages, and/or with reduced regular pressure (albeit periodically spiked), all of which also can lead to lower cost production. Further, one skilled in the art will appreciate that the preceding teachings are further subject to various modifications, substitutions, or alterations, without departing from that inventive scope. Thus, the inventive scope is demonstrated by the teachings herein and is further guided by the exemplary but non-exhaustive claims.

What is claimed is:

1. Apparatus for stimulating production of hydrocarbons from a rock formation, comprising:

a coupling for receiving a frac fluid at a first pressure from a fluid pressure source, the fluid pressure source for providing the frac fluid to a wellbore having a casing; and pressure pulsing apparatus, separate from the fluid pressure source, for periodically altering the first pressure to provide a pulsed frac fluid pressure at least three times greater than the first pressure into the wellbore and to cause the frac fluid to pass through a plurality of perforations in the casing and for the frac fluid at the pulsed frac fluid pressure to form fractures within the rock formation;

wherein the pressure pulsing apparatus is for periodically altering the first pressure to provide a pulsed frac fluid pressure having a pressure of at least 100,000 psi.

2. The apparatus of claim 1 wherein the fluid pressure source comprises a frac fluid pumping engine.

3. The apparatus of claim 2 wherein the frac fluid pumping engine is for providing the first pressure as a constant pressure.

4. The apparatus of claim 1 wherein the apparatus for periodically altering comprises:

a plurality of pistons in fluid communication with the frac fluid; and apparatus for advancing each piston in the plurality of pistons to concurrently apply a same respective pressure, from each piston in the plurality of pistons, to the frac fluid.

5. The apparatus of claim 1 and further comprising diverter introducing apparatus for introducing into the wellbore a plurality of diverters, wherein at least some of the plurality of diverters comprise circuitry.

6. The apparatus of claim 5 wherein the circuitry of a corresponding one of the plurality of diverters comprises circuitry responsive to pressure in the wellbore, and further comprising communication apparatus for communicating data from the circuitry to a device external from the corresponding one of the plurality of diverters.

7. The apparatus of claim 1 wherein the pressure pulsing apparatus is for periodically altering the first pressure to provide a pulsed frac fluid pressure having a pressure from 100,000 psi to 300,000 psi.

8. Apparatus for stimulating production of hydrocarbons from a rock formation, comprising:

a coupling for receiving a frac fluid at a first pressure from a fluid pressure source, the fluid pressure source for providing the frac fluid to a wellbore having a casing; and pressure pulsing apparatus, separate from the fluid pressure source, for periodically altering the first pressure to provide a pulsed frac fluid pressure at least three times greater than the first pressure into the wellbore and to cause the frac fluid to pass through a plurality of perforations in the casing and for the frac fluid at the pulsed frac fluid pressure to form fractures within the rock formation;

wherein the apparatus for periodically altering comprises a reciprocating valve; and wherein the apparatus for periodically altering further comprises a flywheel having a non-circular perimeter, wherein advancment of the non-circular perimeter is for causing a reciprocation of the reciprocating valve.

9. Apparatus for stimulating production of hydrocarbons from a rock formation, comprising:

a coupling for receiving a frac fluid at a first pressure from a fluid pressure source, the fluid pressure source for providing the frac fluid to a wellbore having a casing; and pressure pulsing apparatus, separate from the fluid pressure source, for periodically altering the first pressure to provide a pulsed frac fluid pressure at least three times greater than the first pressure into the wellbore and to cause the frac fluid to pass through a plurality of perforations in the casing and for the frac fluid at the pulsed frac fluid pressure to form fractures within the rock formation;

wherein the apparatus for periodically altering comprises a rotating valve, wherein the rotating valve provides the pulsed frac fluid pressure at a level inversely porportional to a speed of rotation of the rotating valve.

10. The apparatus of claim 9 and further comprising a pressure stank for storing pressure during a cycle corresponding to one of either the first rate or the second rate.

* * * * *